US009964274B2

(12) United States Patent
Lin et al.

(10) Patent No.: US 9,964,274 B2
(45) Date of Patent: May 8, 2018

(54) LIGHT EMITTING DIODE VEHICLE HEADLIGHT

(71) Applicant: Lextar Electronics Corporation, Hsinchu (TW)

(72) Inventors: Yu-Min Lin, New Taipei (TW); Shih-Kai Lin, Tainan (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 107 days.

(21) Appl. No.: 14/955,006

(22) Filed: Nov. 30, 2015

(65) Prior Publication Data

US 2016/0195233 A1 Jul. 7, 2016

(30) Foreign Application Priority Data

Jan. 5, 2015 (TW) ..... 104100107 A

(51) Int. Cl.

| | |
|---|---|
| ***F21S 8/10*** | (2006.01) |
| ***F21V 21/00*** | (2006.01) |
| ***F21V 29/70*** | (2015.01) |
| *F21Y 115/10* | (2016.01) |

(52) U.S. Cl.

CPC ..... *F21S 48/1747* (2013.01); *F21S 48/1154* (2013.01); *F21S 48/1159* (2013.01); *F21S 48/1317* (2013.01); *F21V 29/70* (2015.01); *F21S 48/1258* (2013.01); *F21S 48/1323* (2013.01); *F21S 48/321* (2013.01); *F21S 48/328* (2013.01); *F21Y 2115/10* (2016.08)

(58) Field of Classification Search

CPC ..... F21S 48/1747; F21S 48/1159; F21S 48/1323; F21S 41/00; F21S 41/141; F21S 41/151; F21S 41/20; F21S 41/25; F21S 41/30; F21S 41/321; F21S 41/60; F21S 41/65; F21S 41/663; F21V 29/70

USPC ..... 362/547, 507, 516–522, 538–539, 362/543–545

See application file for complete search history.

(56) References Cited

U.S. PATENT DOCUMENTS

| | | | | |
|---|---|---|---|---|
| 2006/0120094 | A1 | 6/2006 | Tsukamoto et al. | |
| 2007/0086202 | A1 | 4/2007 | Tsukamoto et al. | |
| 2007/0201241 | A1* | 8/2007 | Komatsu ..... | F21S 48/1159 362/545 |

(Continued)

FOREIGN PATENT DOCUMENTS

| | | | |
|---|---|---|---|
| CN | 101144579 | A | 3/2008 |
| CN | 102933895 | A | 2/2013 |

(Continued)

*Primary Examiner* — Jason Moon Han

(74) *Attorney, Agent, or Firm* — CKC & Partners Co., Ltd.

(57) ABSTRACT

An LED vehicle headlight includes a lens, a reflector, a first light source, and a second light source. The lens has a focal plane. The reflector is located at a side of the lens, and the reflector is equipped with a first focal point and a second focal point, wherein the second focal point is located on the focal plane. The first light source has a first light-emitting surface confronting the lens. The second light source has a second light-emitting surface confronting the reflector. The first focal point is located on the second light-emitting surface, and the reflector is configured to reflect and focus light beams emitted from the second light-emitting surface onto the second focal point.

8 Claims, 5 Drawing Sheets

(56) References Cited

U.S. PATENT DOCUMENTS

| | | | | |
|---|---|---|---|---|
| 2007/0253210 | A1* | 11/2007 | Hasegawa | B60Q 1/143 362/464 |
| 2009/0323369 | A1 | 12/2009 | Van As et al. | |
| 2010/0053987 | A1* | 3/2010 | Nakabayashi | F21S 48/1154 362/538 |
| 2011/0280031 | A1* | 11/2011 | Luger | F21S 48/1154 362/520 |
| 2013/0308328 | A1 | 11/2013 | Rice et al. | |

FOREIGN PATENT DOCUMENTS

| | | | |
|---|---|---|---|
| CN | 103423685 | A | 12/2013 |
| DE | 102008051915 | A1 | 4/2009 |
| DE | 102010041096 | A1 | 3/2012 |
| DE | 102012106483 | A1 | 1/2014 |
| JP | 2008-123753 | A | 5/2008 |
| KR | 10-2007-0101154 | A | 10/2007 |
| TW | M485162 | U | 9/2014 |

* cited by examiner

LIGHT EMITTING DIODE VEHICLE HEADLIGHT

RELATED APPLICATIONS

This application claims priority to Taiwanese Application Serial Number 104100107, filed Jan. 5, 2015, which is herein incorporated by reference.

BACKGROUND

Field of Invention

The present disclosure relates to an LED vehicle headlight.

Description of Related Art

The low beam (passing beam) of vehicle headlights is used to illuminate in general driving situation and enabled to avoid causing glare to roadway users. When drivers need farther view of roadway lighting in suburbs or in bad weathers, high beam (driving beam) of vehicle headlights is required.

Currently, different types of shelters are equipped in vehicle headlights to control the switch between low beam and high beam. In passing beam mode, a shelter is worked to block part of light emitted from light sources to form a cut-off line which can remove glare to human eyes. When the vehicle headlight is in a driving beam mode, the shelter may be lowered such that all the light can be projected out to enhance the lighting performance for an automobile exterior environment. However, due to the shelters being commonly driven by mechanical devices which have more risk of unexpected failure, vehicle headlights may have less effective operating life.

SUMMARY

An aspect of the disclosure provides an LED vehicle headlight including a lens, a reflector, a first light source, and a second light source. The lens has a focal plane. The reflector is located at one side of the lens and has a first focal point and a second focal point, wherein the second focal point is located on the focal plane. The light-emitting surface of the first light source confronts the lens; the light-emitting surface of the second light source confronts the reflector. The first focal point of the reflector is located on the light-emitting surface of the second light source, and the reflector is configured to reflect and focus light beams emitted from the light-emitting surface onto the second focal point.

According to one or more embodiments of this disclosure, the LED vehicle headlight includes a heat sink. The heat sink and the reflector are located at the same side of the lens, and apart from the focal plane of the lens. The heat sink has a first outer surface on which the first light source is mounted and a second outer surface on which the second light source is mounted. The first outer surface confronts the lens, and the second outer surface confronts the reflector.

According to one or more embodiments of this disclosure, the lens has an optical axis and a third focal point. The optical axis is perpendicular to the focal plane and intersects the focal plane at the third focal point. A distance between the first outer surface and the third focal point is smaller than or equal to about half of a focal length of the lens. Furthermore, the second focal point and the third focal point are substantially overlapped.

According to one or more embodiments of this disclosure, the optical axis is placed in between the first light source and the second light source.

According to one or more embodiments of this disclosure, the light-emitting surface of the first light source is located at a first side of the optical axis, and configured to emit light beams towards a second opposite side of the optical axis.

According to one or more embodiments of this disclosure, the second outer surface of the heat sink is farther from the focal plane of the lens than the first outer surface is.

According to one or more embodiments of this disclosure, the LED vehicle headlight further includes a controller which can concurrently turn on the first light source and the second light source when high beam is required, or turn on the first light source without turning on the second light source when low beam is required.

According to one or more embodiments of this disclosure, the LED vehicle headlight further includes a housing having an inner space to accommodate the first light source, the second light source, the reflector and an opening to secure the lens.

According to one or more embodiments of this disclosure, the reflector is a cup with a reflective concave surface.

According to one or more embodiments of this disclosure, the first light source and the second light source both comprise light-emitting diodes.

Accordingly, in one or more embodiments of this disclosure, the reflector has the first focal point and the second focal point, and the second focal point is located on the focal plane of the lens. The high beam light source, which confronts the reflector, is located at the first focal point of the reflector. Light reflected by the reflector aggregates at the focal plane of the lens such that the light can be projected out.

On the other hand, the low beam light source, which confronts the lens, is located apart from the focal plane of the lens and its emitted light can be aggregated and directed towards the ground side such that it can serve as a near light source. Therefore, the LED vehicle headlight disclosed herein can achieve the purpose of bi-functional roadway lighting containing the low beam and the high beam without installing any shelter inside so as to prolong its operating life.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
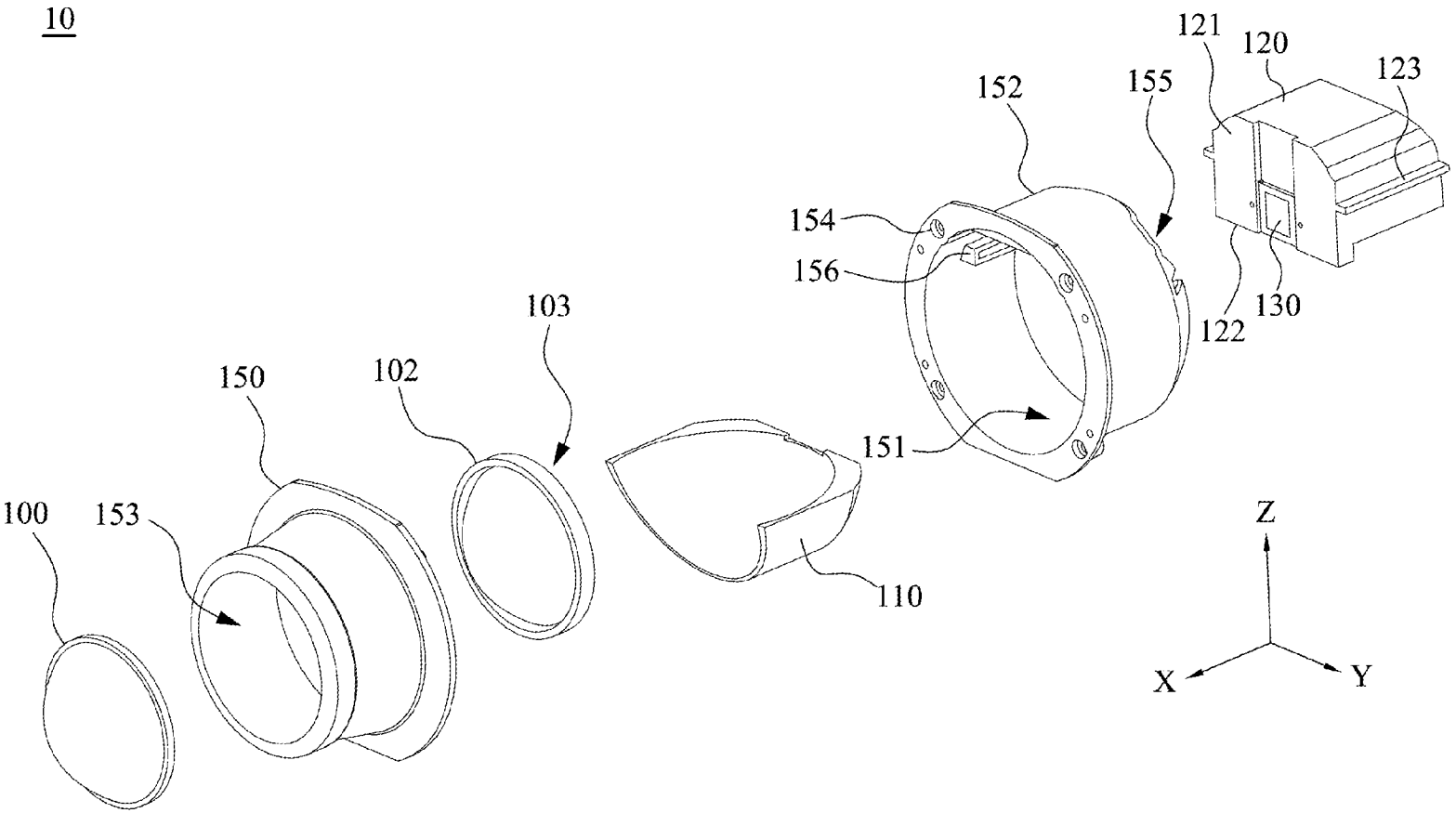
FIG. 1 illustrates an exploded view of an LED vehicle headlight according to one embodiment of this disclosure.

Reference will now be made in detail to the present embodiments of the invention, examples of which are illustrated in the accompanying drawings. Wherever possible, the same reference numbers are used in the drawings and the description to refer to the same or like parts.

Figure 2:
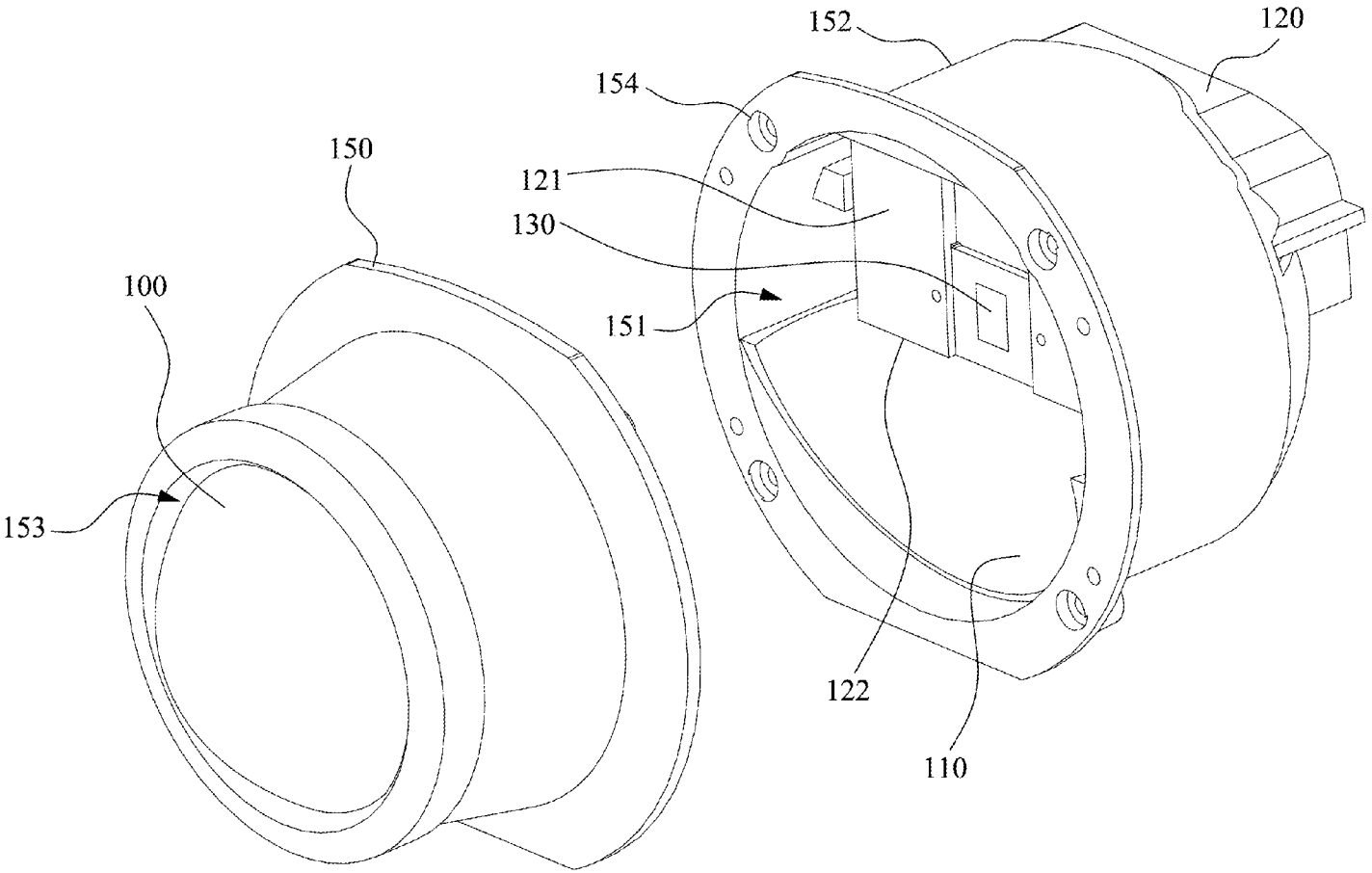
FIG. 2 illustrates an assembly view of the LED vehicle headlight in FIG. 1.
Figure 3:
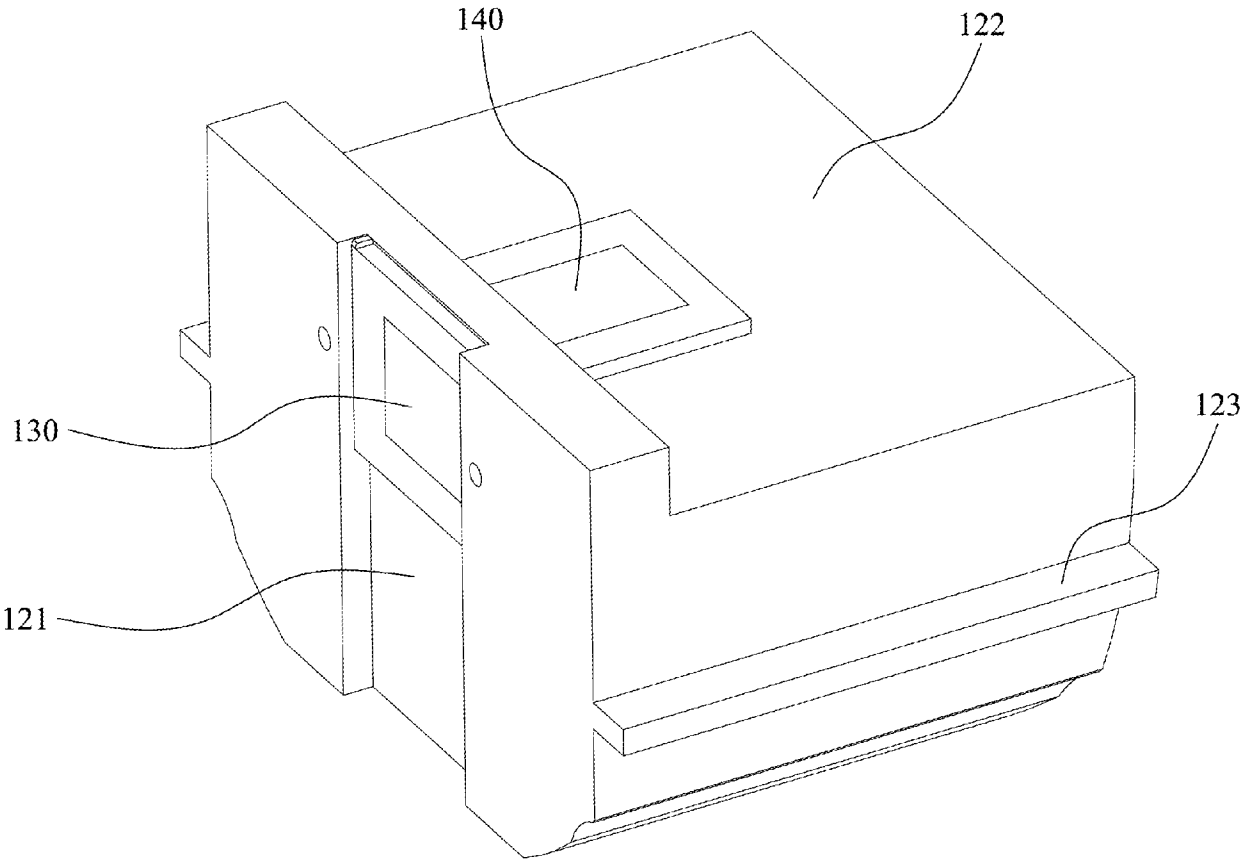
FIG. 3 illustrates an enlarged view of the heat sink in FIG. 1.

FIG. 1 illustrates an exploded view of an LED vehicle headlight according to one embodiment of this disclosure, FIG. 2 illustrates an assembly view of the LED vehicle headlight in FIG. 1, and FIG. 3 illustrates an enlarged view of the heat sink in FIG. 1, wherein the heat sink in FIG. 3 is an upside-down one of the heat sink in FIG. 1. An LED vehicle headlight 10 includes a lens (100, 102), a reflector 110, a heat sink 120, a first light source 130, a second light source 140 and a housing (150, 152). In an embodiment, the reflector 110 can be a cup with a reflective concave surface, e.g., a cup with an elliptical reflective concave surface. The first light source 130 and second light source 140 can be one or more light-emitting diodes. It is noted that the drawings merely illustrate possible embodiments of the reflector 110, and the first, second light sources (130, 140), but not being limited to.

In this embodiment, a housing 152 and a housing 150 can be combined with each other. As illustrated, a periphery part of the housing 152 has several connection holes 154. The housing 150 and the housing 152 can be assembled by inserting joint elements (e.g., bolts) through the connection holes 154. It is noted that the drawings merely illustrates possible embodiments of the housings (150, 152), but not being limited to. In addition, although the housing of this embodiment has two housings (150, 152), the housing is not limited to quantity and shapes disclosed herein. In other embodiments, a single integrally molded housing can be used.

Referring to both FIG. 1 and FIG. 2, the housing 152 has an inner space 151, and a heat-sink-receiving opening 155 at a remote side (e.g., remote from the housing 150). The heat sink 120 can be installed into the housing 152 through the heat-sink-receiving opening 155. In particular, the inner space 151 of the housing 152 has two inner rails 156, and the heat sink 120 has two lateral tenons 123. When the heat sink 120 is installed into the housing 152 through the heat-sink-receiving opening 155, the lateral tenons 123 can be slid along the inner rails 156 until the heat sink 120 is moved to a predetermined position. It is noted that the drawings merely illustrate possible ways the heat sink 120 can be mounted into the housing 152, but not being limited to. In other embodiments, the heat sink 120 may be installed into the housing 152 via other directions or other ways.

Referring to both FIG. 1 and FIG. 2, the reflector 110 can be installed into the inner space 151 of the housing 152 through a front side (i.e., the side confronting the housing 150). Referring to FIG. 3, the first light source 130 and the second light source 140 can be mounted on the heat sink 120. Thus, when the heat sink 120 and the reflector 110 are installed within the inner space 151, the first light source 130 and the second light source 140 are also accommodated within the inner space 151. The housing 150 has an opening 153, and the lenses (100, 102) are mounted into the opening 153. When the two housings (150, 152) are assembled to enclose all associated components, a complete LED vehicle headlight 10 is accomplished. It is noted that the drawings merely illustrate possible ways of mounting the components within the housing. In other embodiments, the heat sink 120, the reflector 110, the first light source 130 and the second light source 140 can be installed into the housings (150, 152) in other ways, and the lenses (100, 102) can be secured to the opening 153 of the housing 150 in other ways. In this embodiment, two lenses (100, 102) are combined to serve as the lens system of the LED vehicle headlight 10. In other embodiments, the LED vehicle headlight 10 may have one or more than two lenses to serve as its lens system.

Referring to FIGS. 1-3, the reflector 110 and the heat sink 120 are located at the same side 103 of the lenses (100, 102). In an assembled LED vehicle headlight 10, the first light source 130 and the second light source 140 are both mounted on the heat sink 120, and a light-emitting surface of the first light source 130 confronts the lenses (100, 102), a light-emitting surface of the second light source 140 confronts the reflector 110. In particular, referring to FIG. 3, the heat sink 120 includes a first outer surface 121 on which the first light source 130 is mounted and a second outer surface 122 on which the second light source 140 is mounted. In this embodiment, the first outer surface 121 and the second outer surface 122 are immediately-adjacent to each other, but not being limited to. Referring to FIG. 1 and FIG. 2, when the heat sink 120 is installed into the housing 152, the first outer surface 121 confronts the lenses (100, 102), the second outer surface 122 confronts the reflector 110. And, the first light source 130 can be located apart from a focal point of the lens system composed of the lenses (100, 102) such that the light emitted from the first light source 130 can be aggregated through the lens (100, 102). In addition, the light emitted from the second light source 140 can be reflected and aggregated at the focal point of the lenses (100, 102) by the reflector 110 such that the light emitted from the second light source 140 can be projected out as the approximately parallel light via the focal point of the lenses (100, 102).

With this regard, in this embodiment of the LED vehicle headlight 10, the first light source 130 serves as a low beam light source, and the second light source 140 serves as a high beam light source. Therefore, the LED vehicle headlight 10 in this embodiment does not necessitate a shelter to switch between a low beam and a high beam so as to avoid mechanical failures that affect the life of the LED vehicle headlight 10.

Figure 4:
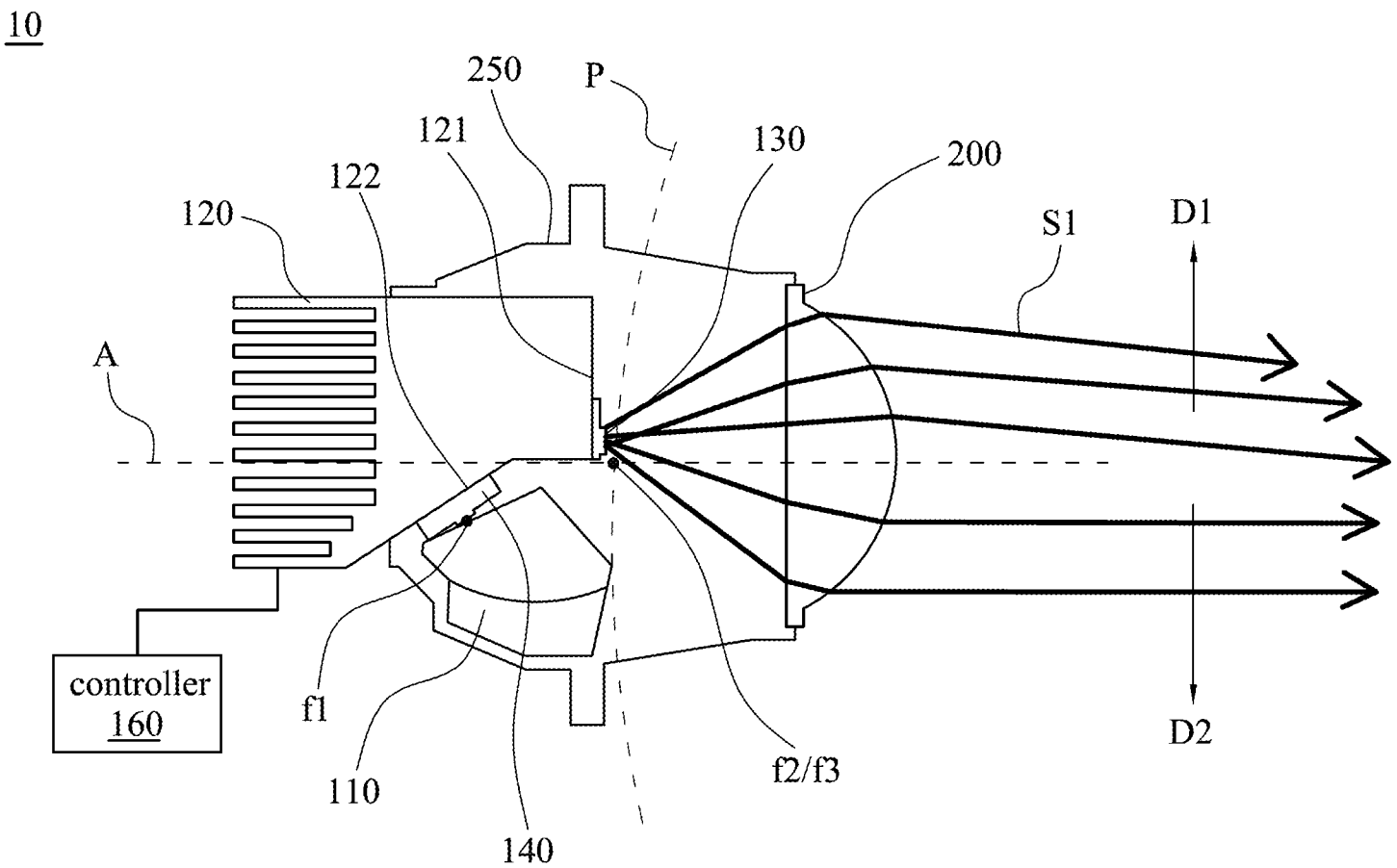
FIG. 4 illustrates a light-path schematic view of the low beam mode of the LED vehicle headlight according to one embodiment of this disclosure.
Figure 5:
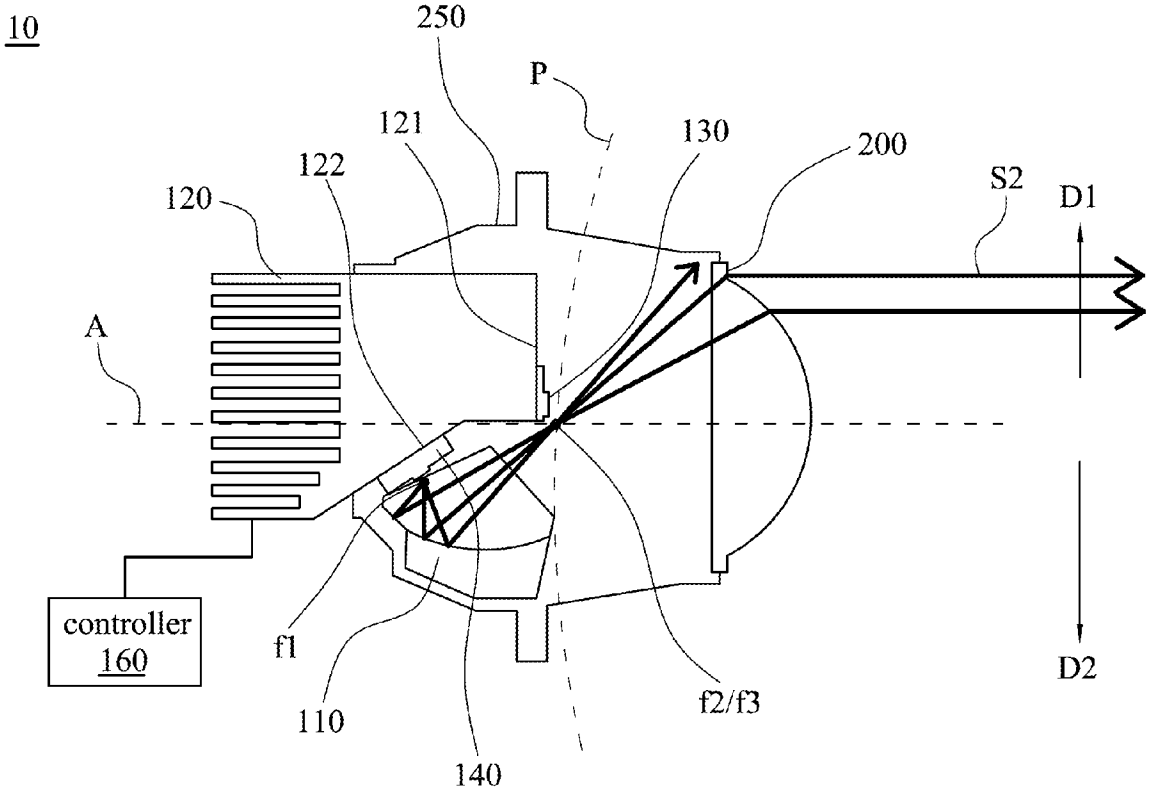
FIG. 5 illustrates a light-path schematic view of the high beam mode of the LED vehicle headlight according to another embodiment of this disclosure.

Referring to FIG. 4 and FIG. 5, wherein FIG. 4 illustrates a light-path schematic view of the low beam mode of the LED vehicle headlight 10 according to one embodiment of this disclosure, and FIG. 5 illustrates a light-path schematic view of the high beam mode of the LED vehicle headlight 10 according to another embodiment of this disclosure. As illustrated in FIG. 4 and FIG. 5, in order to simplify the light-path among the components, a single lens 200 serves as the lens system of the LED vehicle headlight 10, and a single housing 250 serves as an enclosure of the LED vehicle headlight 10.

As illustrated, the lens 200 (or lens system in other embodiments) may have a focal plane P. The heat sink 120 is apart from the lens 200 and its focal plane P. That is, the heat sink 120 is apart from the lens 200 by a distance greater than a focal length of the lens 200. In particular, the second outer surface 122 is farther from the focal plane P than the first outer surface 121 is. In this embodiment, the first light source 130 is mounted on the first outer surface 121, and the first light source 130 is also apart from the focal plane P. With this regard, light beams S1 emitted from the first light source 130 can be aggregated through the refraction of the lens 200 so as to serve as a low beam light source of the LED vehicle headlight 10.

In this embodiment, the reflector 110 can be a cup with a reflective concave surface, which has a first focal point f1 and a second focal point f2, wherein the second focal point f2 substantially overlaps the focal plane P. That is, the second focal point f2 is located on the focal plane P. The second light source 140 is mounted on the second outer surface 122 of the heat sink 120, and the first focal point f1 is located on a light-emitting surface of the second light source 140. With this regard, light beams S2 emitted from the light-emitting surface of the second light source 140 can be reflected and aggregated onto the second focal point f2 by means of the reflector 110.

In addition, the lens 200 has an optical axis A and a third focal point f3, wherein the optical axis A is perpendicular to the focal plane P and intersects the focal plane P at the third focal point f3, and the optical axis A is placed in between the first light source 130 and the second light source 140. In this embodiment, the third focal point f3 of the lens 200 and the second focal point f2 of the reflector 110 are substantially overlapped. That is, the third focal point f3 of the lens 200 and the second focal point f2 of the reflector 110 are both located on the focal plane P of the lens 200. Because the third focal point f3 of the lens 200 and the second focal point f2 of the reflector 110 are substantially overlapped, the light beams S2 aggregated at the second focal point f2 can be projected out as the approximately parallel light via the third focal point f3 of the lens 200. Therefore, in this embodiment, the light beams S2 emitted from the second light source 140 can be reflected by the reflector 110 and refracted by the lens 200 to be approximately parallel light, which serves as a far light source of the LED vehicle headlight 10.

Referring to FIG. 4 and FIG. 5 again, the first light source 130 is not located on the optical axis A, but located at a first side of the optical axis A. The light beams S1 emitted from the first light source 130 are directed towards a second opposite side of the optical axis A. As illustrated in FIG. 4, the first light source 130 at a first side D1 of the optical axis A, and the light beams S1 emitted from the first light source 130 are directed towards a second opposite side D2 of the optical axis A. With this regard, in practice, the light beams S1 emitted from the first light source 130 are directed towards the ground to prevent the light beams S1 from being directed towards the eyes of passers-by.

In an embodiment, the light-emitting surface of the first light source 130 is apart from the focal plane P of the lens 200 and located at a side D1 of the optical axis A, wherein a distance between the light-emitting surface of the first light source 130 and the third focal point f3 of the lens 200 is equal to or less than half of a focal length of the lens 200. When the distance between the light-emitting surface of the first light source 130 and the third focal point f3 of the lens 200 is greater than half of the focal length of the lens 200, the light beams S1 emitted from the first light source 130 are directed too much towards the second opposite side D2 of the optical axis A, thereby reducing the projection distance of the light beams S1.

Referring to FIG. 4 and FIG. 5 again, the first light source 130 and the second light source 140 can be selectively turned on. In particular, the LED vehicle headlight 10 may include a controller 160. The controller 160 is configured to turn on both the first light source 130 and the second light source 140 in a driving beam mode (also referred as a high beam mode in which the light beam is projected to a greater distance), and turn on the first light source 130 and turn off the second light source 140 in a passing beam mode (also referred as a low beam mode in which the light beam is projected to a shorter distance). With this regard, Therefore, the LED vehicle headlight 10 in this embodiment does not necessitate a shelter to switch between a near light source and a far light source so as to avoid mechanical failures or the like other factors that affect the life of the LED vehicle headlight 10.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A light-emitting diode vehicle headlight comprising:
- a lens having a focal plane and an optical axis;
- a reflector disposed at a side of the lens and below the optical axis of the lens, the reflector having a first focal point and a second focal point, wherein the second focal point is located on the focal plane;
- a first light source having a first light-emitting surface confronting the lens;
- a second light source having a second light-emitting surface confronting the reflector, the first focal point is located on the second light-emitting surface, and the reflector is configured to reflect and focus light beams emitted from the second light-emitting surface onto the second focal point, wherein the optical axis of the lens is placed in between the first light source and the second light source; and
- a controller configured to:
  - turn on both the first light source and the second light source in a driving beam mode; and
  - turn on the first light source and turn off the second light source in a passing beam mode.

2. The light-emitting diode vehicle headlight of claim 1 further comprising a heat sink, the heat sink and the reflector are disposed at the same side of the lens, and apart from the focal plane of the lens, the heat sink having a first outer surface on which the first light source is mounted and a second outer surface on which the second light source is mounted, the first outer surface confronting the lens, the second outer surface confronting the reflector.

3. The light-emitting diode vehicle headlight of claim 2, wherein the lens has a third focal point, the optical axis is perpendicular to the focal plane and intersects the focal plane at the third focal point, a distance between the first outer surface and the third focal point is smaller than or equal to half of a focal length of the lens, the second focal point and the third focal point are substantially overlapped.

4. The light-emitting diode vehicle headlight of claim 3, wherein the first light-emitting surface is located at a first side of the optical axis, and configured to emit light beams towards a second opposite side of the optical axis.

5. The light-emitting diode vehicle headlight of claim 2, wherein the second outer surface is farther from the focal plane than the first outer surface is.

6. The light-emitting diode vehicle headlight of claim 1 further comprising a housing having an inner space to accommodate the first light source, the second light source and the reflector and an opening to secure the lens.

7. The light-emitting diode vehicle headlight of claim 1, wherein the reflector is a cup with a reflective concave surface.

8. The light-emitting diode vehicle headlight of claim 1, wherein the first light source and the second light source both comprise light-emitting diodes.

* * * * *